US009276319B2

(12) United States Patent
Vazquez et al.

(10) Patent No.: US 9,276,319 B2
(45) Date of Patent: Mar. 1, 2016

(54) ELECTRONIC DEVICE ANTENNA WITH MULTIPLE FEEDS FOR COVERING THREE COMMUNICATIONS BANDS

(71) Applicant: Apple Inc., Cupertino, CA (US)

(72) Inventors: Enrique Ayala Vazquez, Watsonville, CA (US); Hongfei Hu, Santa Clara, CA (US); Mattia Pascolini, San Mateo, CA (US); Matthew A. Mow, Los Altos, CA (US); Ming-Ju Tsai, Cupertino, CA (US); Robert W. Schlub, Cupertino, CA (US); Dean F. Darnell, San Jose, CA (US); Yuehui Ouyang, Sunnyvale, CA (US); Nanbo Jin, Sunnyvale, CA (US); Liang Han, Sunnyvale, CA (US); David Pratt, Gilroy, CA (US)

(73) Assignee: Apple Inc., Cupertino, CA (US)

( * ) Notice: Subject to any disclaimer, the term of this patent is extended or adjusted under 35 U.S.C. 154(b) by 406 days.

(21) Appl. No.: 13/889,987

(22) Filed: May 8, 2013

(65) Prior Publication Data

US 2014/0333495 A1 Nov. 13, 2014

(51) Int. Cl.
*H01Q 1/24* (2006.01)
*H01Q 1/38* (2006.01)
(Continued)

(52) U.S. Cl.
CPC ..... *H01Q 9/06* (2013.01); *H01Q 1/243* (2013.01); *H01Q 5/328* (2015.01); *H01Q 5/35* (2015.01);
(Continued)

(58) Field of Classification Search
USPC ..... 343/700 MS, 702, 745
See application file for complete search history.

(56) References Cited

U.S. PATENT DOCUMENTS 6,529,749 B1 3/2003 Hayes et al.
6,662,028 B1 12/2003 Hayes et al.
(Continued)

FOREIGN PATENT DOCUMENTS

EP 2405534 1/2012
EP 2528165 11/2012
WO 0003453 1/2000

OTHER PUBLICATIONS

Bevelacqua et al., U.S. Appl. No. 13/860,396, filed Apr. 10, 2013.
(Continued)

*Primary Examiner* — Tan Ho
(74) *Attorney, Agent, or Firm* — Treyz Law Group, P.C.; G. Victor Treyz; Michael H. Lyons

(57) ABSTRACT

Electronic devices may be provided that include radio-frequency transceiver circuitry and antennas. An antenna may be formed from an antenna resonating element and an antenna ground. The antenna resonating element may have a shorter portion that resonates at higher communications band frequencies and a longer portion that resonates at lower communications band frequencies. An extended portion of the antenna ground may form an inverted-F antenna resonating element portion of the antenna resonating element. The antenna resonating element may be formed from a peripheral conductive electronic device housing structure that is separated from the antenna ground by an opening. A first antenna feed may be coupled between the peripheral conductive electronic device housing structures and the antenna ground across the opening. A second antenna feed may be coupled to the inverted-F antenna resonating element portion of the antenna resonating element.

20 Claims, 9 Drawing Sheets

(51) Int. Cl.

| | |
|---|---|
| ***H01Q 9/06*** | (2006.01) |
| ***H01Q 9/27*** | (2006.01) |
| ***H01Q 9/42*** | (2006.01) |
| ***H01Q 13/10*** | (2006.01) |
| ***H01Q 5/328*** | (2015.01) |
| ***H01Q 5/35*** | (2015.01) |
| ***H01Q 5/371*** | (2015.01) |
| *H01Q 1/48* | (2006.01) |
| *H01Q 9/04* | (2006.01) |

(52) U.S. Cl.

CPC ..... *H01Q 5/371* (2015.01); *H01Q 9/27* (2013.01); *H01Q 9/42* (2013.01); *H01Q 13/10* (2013.01); *H01Q 1/48* (2013.01); *H01Q 9/0442* (2013.01)

(56) References Cited

U.S. PATENT DOCUMENTS

| | | | | |
|---|---|---|---|---|
| 6,922,172 | B2 | 7/2005 | Oshiyama et al. | |
| 6,950,069 | B2 | 9/2005 | Gaucher et al. | |
| 7,671,804 | B2 | 3/2010 | Zhang et al. | |
| 2003/0189522 | A1 | 10/2003 | Zeilinger | |
| 2010/0238079 | A1 | 9/2010 | Aystollahi et al. | |
| 2012/0157175 | A1 * | 6/2012 | Golko | G06F 1/1698 455/575.7 |
| 2013/0033413 | A1 | 2/2013 | Du et al. | |
| 2013/0050046 | A1 | 2/2013 | Jarvis et al. | |
| 2013/0201067 | A1 * | 8/2013 | Hu | H01Q 1/243 343/745 |
| 2014/0292587 | A1 * | 10/2014 | Yarga | H01Q 1/243 343/702 |

OTHER PUBLICATIONS

Hu et al., U.S. Appl. No. 13/890,013, filed May 8, 2013.
Bevelacqua et al., U.S. Appl., No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.
Darnell et al., U.S. Appl. No. 13/368,855, filed Feb. 8, 2012.
Hu et al., U.S. Appl. No. 13/366,142, filed Feb. 3, 2012.
Pascolini et al., U.S. Appl. No. 13/343,657, filed Jan. 4, 2012.
Darnell et al., U.S. Appl. No. 13/435,351, filed Mar. 30, 2012.

* cited by examiner

ELECTRONIC DEVICE ANTENNA WITH MULTIPLE FEEDS FOR COVERING THREE COMMUNICATIONS BANDS

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive structures can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

Electronic devices may be provided that contain wireless communications circuitry. The wireless communications circuitry may include radio-frequency transceiver circuitry and antennas. An antenna may be formed from an antenna resonating element and an antenna ground.

The antenna resonating element may have a longer portion that resonates at first communications band frequencies and a shorter portion that resonates at second communications band frequencies above the first communications band frequencies. The resonating element may be formed from peripheral conductive electronic device housing structures that are separated from the antenna ground by an opening.

An extended portion of the antenna ground may form an inverted-F antenna resonating element portion of the antenna resonating element that resonates at third communications band frequencies above the first and second communications band frequencies.

A first antenna feed may be coupled between the peripheral conductive electronic device housing structures and the antenna ground across the opening. A second antenna feed may be coupled to the inverted-F antenna resonating element portion of the antenna resonating element.

An adjustable component such as a tunable inductor may be coupled between the antenna resonating element and antenna ground for tuning the antenna. The shorter portion of the antenna resonating element may be formed from a portion of the peripheral conductive electronic device housing structures and may serve as a first branch of an inverted-F antenna resonating element arm. The inverted-F antenna resonating element arm may also have a second branch. The first and second branches may be characterized by respective first and second antenna resonance peaks within the first communications band.

Further features of the invention, its nature and various advantages will be more apparent from the accompanying drawings and the following detailed description of the preferred embodiments.

DETAILED DESCRIPTION

Figure 1:
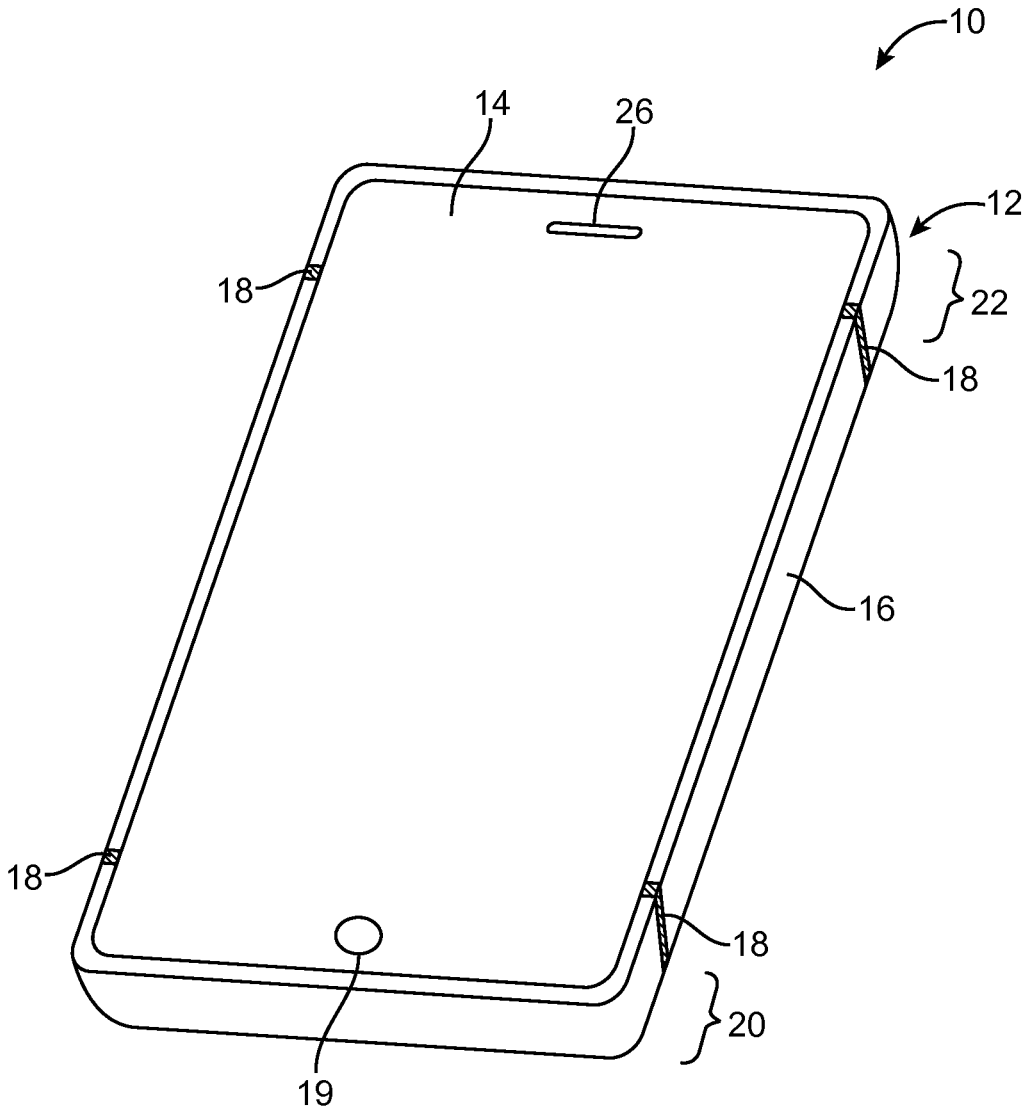
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer formed from clear glass, transparent plastic, or other transparent dielectric may cover the surface of display 14. Buttons such as button 19 may pass through openings in the display cover layer. The cover layer may also have other openings such as an opening for speaker port 26.

Housing 12 may include a peripheral member such as member 16. Member 16 may run around the periphery of device 10 and display 14. In configurations in which device 10 and display 14 have a rectangular shape, member 16 may have a rectangular ring shape (as an example). Member 16 or part of member 16 may serve as a bezel for display 14 (e.g., a cosmetic trim that surrounds all four sides of display 14 and/or helps hold display 14 to device 10). Member 16 may also, if desired, form sidewall structures for device 10 (e.g., by forming a metal band with vertical sidewalls surrounding the periphery of device 10, etc.).

Member 16 may be formed of a conductive material and may therefore sometimes be referred to as a peripheral conductive member, peripheral conductive housing member, or conductive housing structures. Member 16 may be formed from a metal such as stainless steel, aluminum, or other suitable materials. One, two, or more than two separate structures (e.g., segments) may be used in forming member 16.

It is not necessary for member 16 to have a uniform cross-section. For example, the top portion of member 16 may, if desired, have an inwardly protruding lip that helps hold display 14 in place. If desired, the bottom portion of member 16 may also have an enlarged lip (e.g., in the plane of the rear surface of device 10). In the example of FIG. 1, member 16 has substantially straight vertical sidewalls. This is merely illustrative. The sidewalls of member 16 may be curved or may have any other suitable shape. In some configurations (e.g., when member 16 serves as a bezel for display 14), member 16 may run around the lip of housing 12 (i.e., member 16 may cover only the edge of housing 12 that surrounds display 14 and not the rear edge of housing 12 of the sidewalls of housing 12). Integral portions of the metal structure that forms member 16 may, if desired, extend across the rear of device 10 (e.g., housing 12 may have a planar rear portion and portions of peripheral conductive member 16 may be formed from sidewall portions of that extend vertically upwards from the planar rear portion).

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular member that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive member 16 and opposing conductive structures such as conductive housing structures, a conductive ground plane associated with a printed circuit board, and conductive electrical components in device 10). These openings may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of member 16 may be provided with gap structures. For example, member 16 may be provided with one or more gaps (splits) such as gaps 18, as shown in FIG. 1. The gaps may be filled with dielectric such as polymer, ceramic, glass, air, other dielectric materials, or combinations of these materials. Gaps 18 may divide member 16 into one or more peripheral conductive member segments. There may be, for example, two segments of member 16 (e.g., in an arrangement with two gaps), three segments of member 16 (e.g., in an arrangement with three gaps), four segments of member 16 (e.g., in an arrangement with four gaps, etc.). The segments of peripheral conductive member 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
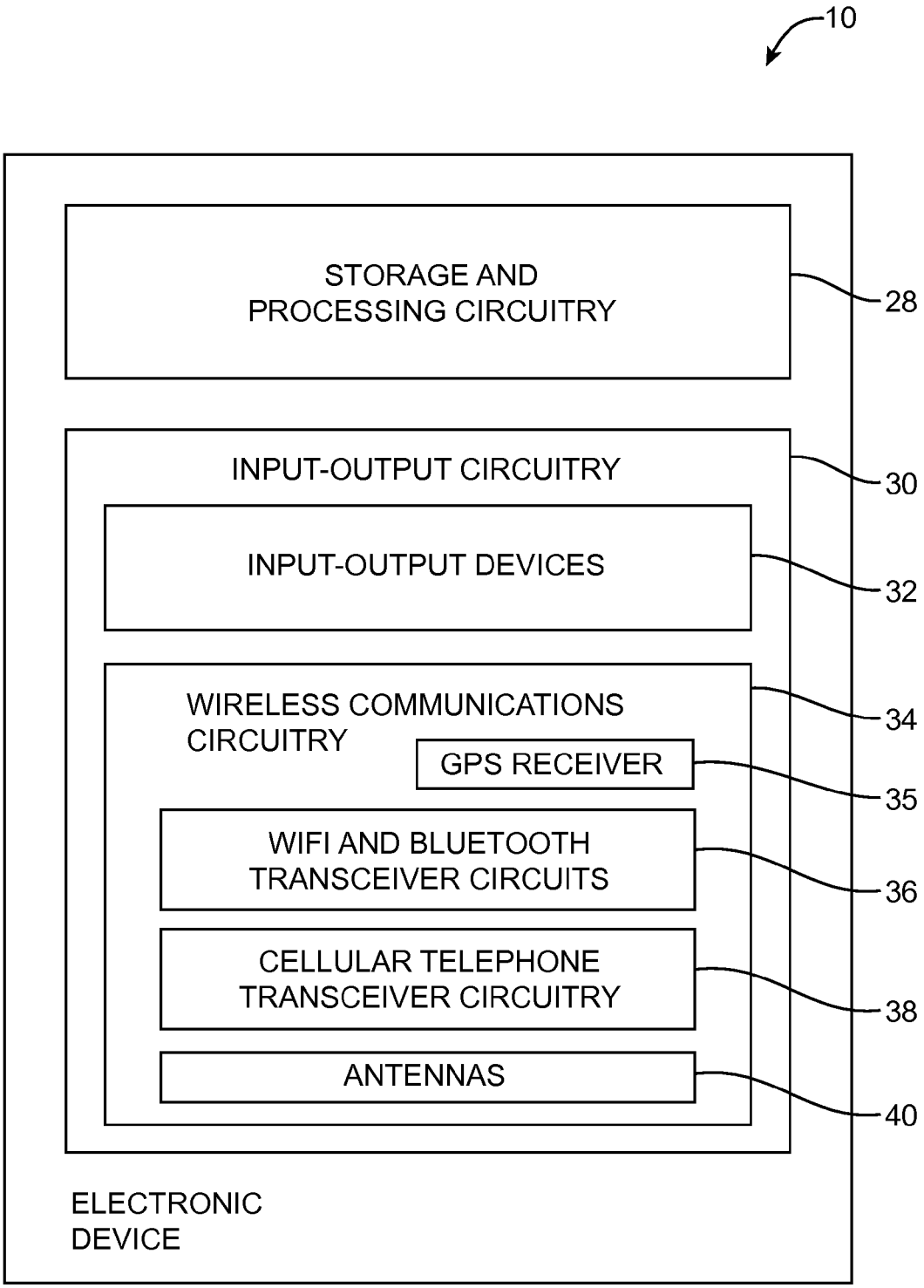
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc. In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle wireless local area network communications. For example, transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may be formed using any suitable antenna types. For example, antennas 40 may include antennas with resonating elements that are formed from loop antenna structure, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link.

If desired, one or more of antennas 40 may be provided with tunable circuitry. The tunable circuitry may include switching circuitry based on one or more switches. The switching circuitry may, for example, include a switch that can be placed in an open or closed position. When control circuitry 28 of device 10 places the switch in its open position, an antenna may exhibit a first frequency response. When control circuitry 28 of device 10 places the switch in its closed position, the antenna may exhibit a second frequency response. Tunable circuitry for one or more of antennas 40 may also be based on switching circuitry that can switch selected circuit components into use. For example, an adjustable inductor may operate in a first mode in which a first inductor is switched into use and a second mode in which a second inductor is switched into use. An adjustable inductor may optionally also be switched into a mode in which a short circuit is switched into use or in which an open circuit is formed. Using adjustable inductors such as these or other adjustable circuit components, the performance of antenna 40 may be adjusted in real time to cover operating frequencies of interest.

Antenna 40 may exhibit multiple resonances. For example, antenna 40 may be configured to exhibit resonances in a low band, a middle band, and a high band (as examples). Low band communications frequencies may include communications frequencies from 700 MHz to 960 MHz, middle band communications frequencies may include communications frequencies from 1710 to 2170 MHz, and high band communications frequencies may include communications frequencies from 2300 to 2700 MHz (as examples). Other communications frequencies can be covered using antenna 40, if desired. Configurations in which antenna 40 covers low, middle, and high communications bands are merely illustrative.

Adjustment of the state of adjustable inductors or other adjustable circuit components may be used to tune antenna 40. For example, adjustments to the state of one or more adjustable inductor circuits may be used to tune the low band response of antenna 40 without appreciably affecting the middle and high band responses. The ability to adjust the response of the antenna may allow the antenna to cover communications frequencies of interest.

Figure 3:
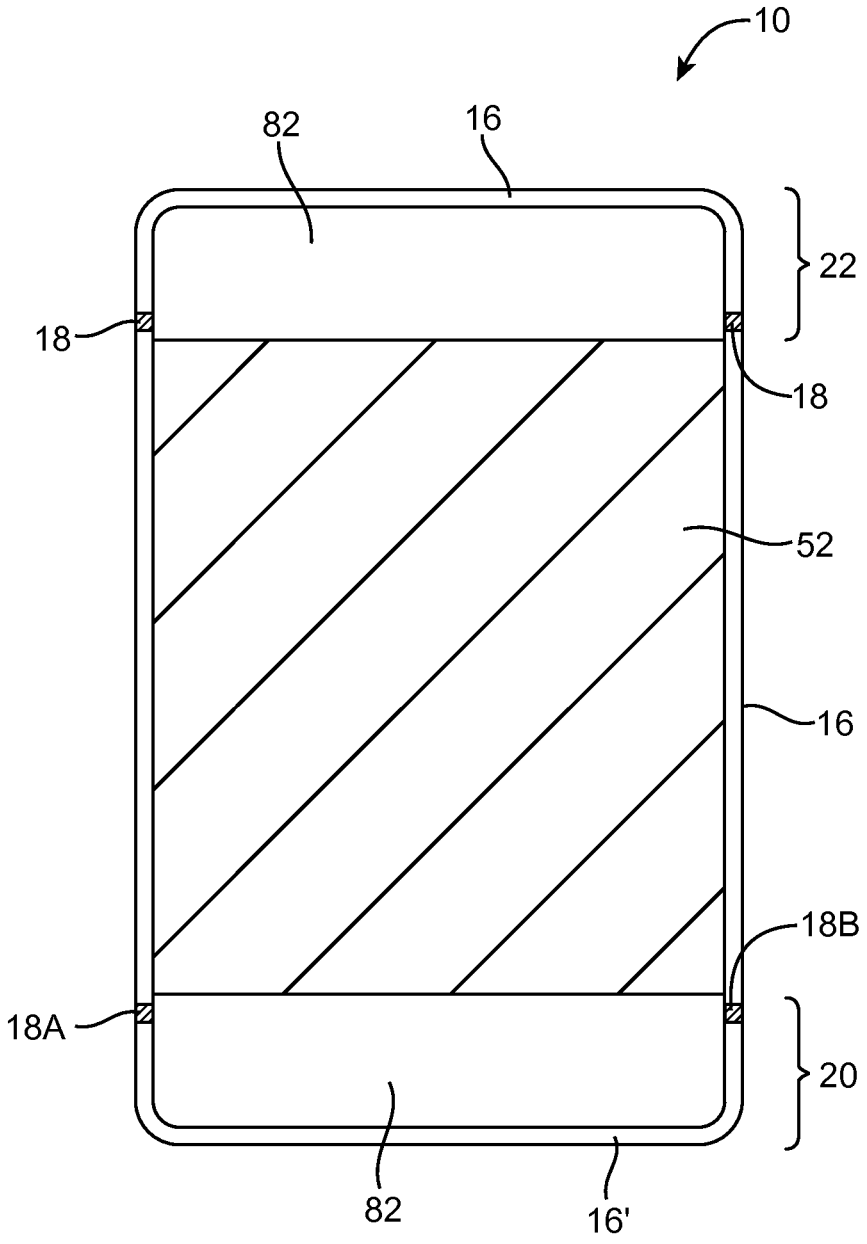
FIG. 3 is a top view of an illustrative electronic device of the type shown in FIG. 1 in which antennas may be formed using conductive housing structures such as portions of a peripheral conductive housing member in accordance with an embodiment of the present invention.

A top interior view of device 10 in a configuration in which device 10 has a peripheral conductive housing member such as housing member 16 of FIG. 1 with one or more gaps 18 is shown in FIG. 3. As shown in FIG. 3, device 10 may have an antenna ground plane such as antenna ground plane 52. Ground plane 52 may be formed from traces on printed circuit boards (e.g., rigid printed circuit boards and flexible printed circuit boards), from conductive planar support structures in the interior of device 10, from conductive structures that form exterior parts of housing 12, from conductive structures that are part of one or more electrical components in device 10 (e.g., parts of connectors, switches, cameras, speakers, microphones, displays, buttons, etc.), or other conductive device structures. Gaps such as gaps (openings) 82 may be filled with air, plastic, or other dielectric.

One or more segments of peripheral conductive member 16 may serve as antenna resonating elements for an antenna in device 10. For example, the uppermost segment of peripheral conductive member 16 in region 22 may serve as an antenna resonating element for an upper antenna in device 10 and the lowermost segment of peripheral conductive member 16 in region 20 (i.e., segment 16', which extends between gap 18A and gap 18B) may serve as an antenna resonating element for a lower antenna in device 10. The conductive materials of peripheral conductive member 16, the conductive materials of ground plane 52, and dielectric-filled openings 82 (and gaps 18) may be used in forming one or more antennas in device 10 such as an upper antenna in region 22 and a lower antenna in region 20. Configurations in which an antenna in lower region 20 is implemented using a tunable frequency response configuration are sometimes described herein as an example.

Figure 4:
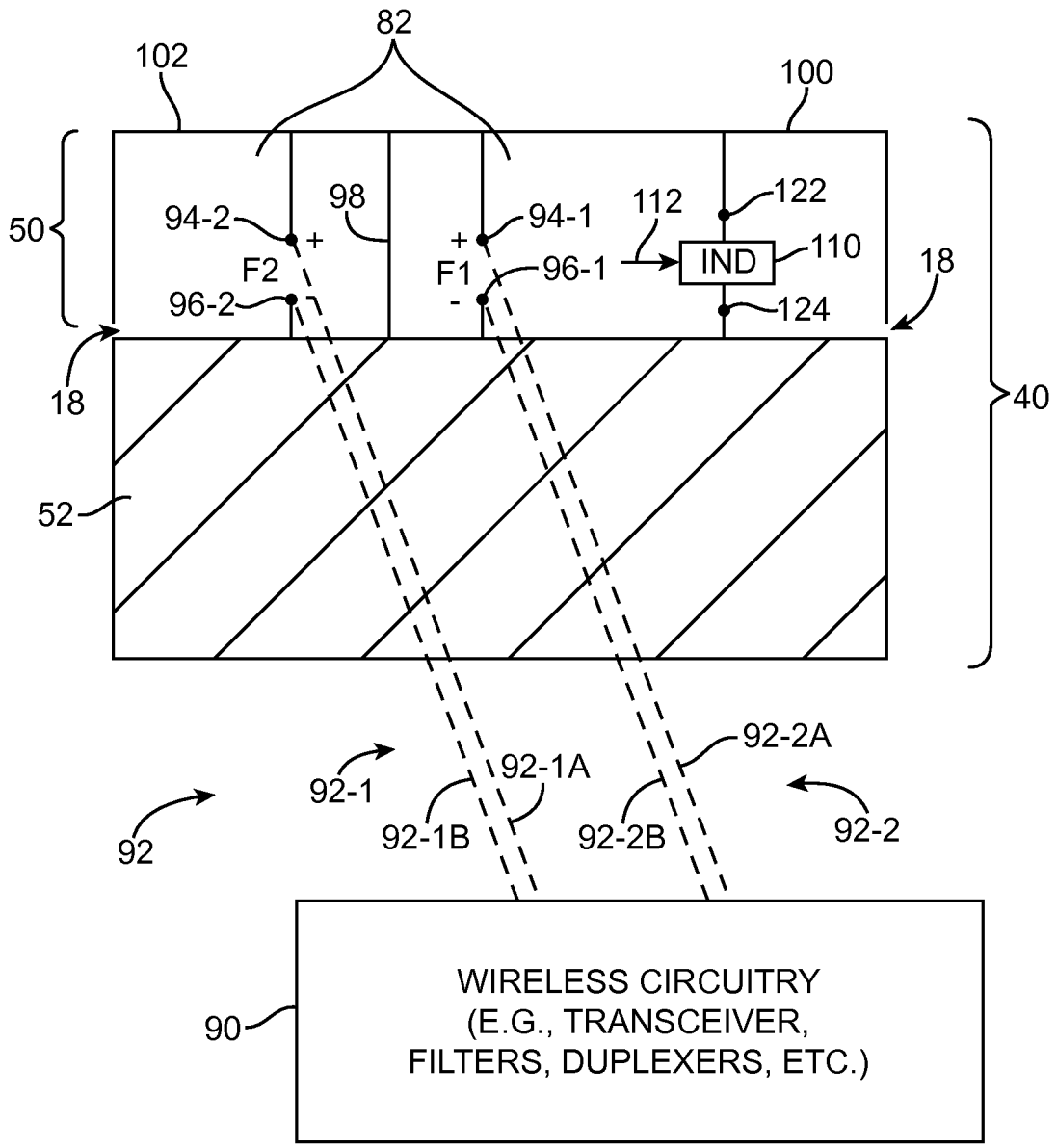
FIG. 4 is a circuit diagram showing how an antenna in the electronic device of FIG. 1 may be coupled to radio-frequency transceiver circuitry in accordance with an embodiment of the present invention.

Illustrative antenna structures of the type that may be used in device 10 (e.g., in region 20 and/or region 22) are shown in FIG. 4. Antenna structures 40 of FIG. 4 include an antenna resonating element of the type that is sometimes referred to as a dual arm inverted-F antenna resonating element or T antenna resonating element. As shown in FIG. 4, antenna structures 40 may have conductive antenna structures such as dual arm inverted-F antenna resonating element 50 and antenna ground 52. The conductive structures that form antenna resonating element 50 and antenna ground 52 may be formed from parts of conductive housing structures, from parts of electrical device components in device 10, from printed circuit board traces, from strips of conductor such as strips of wire and metal foil, or may be formed using other conductive structures.

As shown in FIG. 4, antenna structures 40 may be coupled to wireless circuitry 90 such as transceiver circuitry, filters, switches, duplexers, impedance matching circuitry, and other circuitry using transmission line structures such as transmission line structures 92. Transmission line structures 92 may include transmission lines such as transmission line 92-1 and transmission line 92-2. Transmission line 92-1 may have positive signal path 92-1A and ground signal path 92-1B. Transmission line 92-2 may have positive signal path 92-2A and ground signal path 92-2B. Paths 92-1A, 92-1B, 92-2A, and 92-2B may be formed from metal traces on rigid printed circuit boards, may be formed from metal traces on flexible printed circuits, may be formed on dielectric support structures such as plastic, glass, and ceramic members, may be formed as part of a cable, or may be formed from other conductive signal lines. Transmission line structures 92 may be formed using one or more microstrip transmission lines, stripline transmission lines, edge coupled microstrip transmission lines, edge coupled stripline transmission lines, coaxial cables, or other suitable transmission line structures. Circuits such as impedance matching circuits, filters, switches, duplexers, diplexers, and other circuitry may, if desired, be interposed in the transmission lines of structures 92.

Transmission line structures 92 may be coupled to antenna feeds formed using antenna feed terminals 94-1 and 96-1 (which form a first antenna feed F1) and antenna feed terminals 94-2 and 96-2 (which form a second antenna feed F2). Terminal 94-1 may be a positive antenna feed terminal and terminal 96-1 may be a ground antenna feed terminal for first antenna feed F1. Terminal 94-2 may be a positive antenna feed terminal and terminal 96-2 may be a ground antenna feed terminal for second antenna feed F2.

The antenna feeds in antenna structures 40 may be used in handling the same types of signals or different types of signals. For example, the first feed may be used for transmitting and/or receiving antenna signals in a first communications band or first set of communications bands and the second feed may be used for transmitting and/or receiving antenna signals in a second communications band or second set of communications bands or the first and second feeds may collectively be used in transmitting signals in multiple communications bands (e.g., in a configuration in which transmission lines 92-1 and 92-2 are branches of a common transmission line that are coupled together using a splitter).

If desired, tunable components such as adjustable capacitors, adjustable inductors, filter circuitry such as band-pass filter circuitry, band-stop filter circuitry, high pass filter circuitry, and low pass filter circuitry, switches, impedance matching circuitry, duplexers, diplexers, splitters, and other circuitry may be interposed within transmission line paths 92 (i.e., between wireless circuitry 90 and the respective feeds of antenna structures 40). The different feeds in antenna structures 40 may each exhibit a different impedance and antenna resonance behavior as a function of operating frequency. Wireless circuitry 90 may therefore use different feeds or combinations of feeds for different signal frequencies, if desired. Duplexers or other filter circuitry may route signals to and from the feeds of antenna 40 as a function of frequency.

Antenna resonating element 50 may include a short circuit branch such as branch 98 that couples resonating element arm structures such as arms 100 and 102 to antenna ground 52. Arms such as arms 100 and 102 may be formed from segment 16' of peripheral conductive housing member 16 or other conductive structures in device 10. Dielectric opening (gap) 82 separates arms 100 and 102 from antenna ground 52. Antenna ground 52 may be formed from housing structures such as a metal midplate member, printed circuit traces, metal portions of electronic components, or other conductive ground structures. Opening 82 may be formed by air, plastic, and other dielectric materials. Short circuit branch 98, which may sometimes be referred to as a return path or short circuit path, may be implemented using a strip of metal, a metal trace on a dielectric support structure such as a printed circuit or plastic carrier, or other conductive path that is coupled across dielectric-filled opening 82 and therefore bridges opening 82 between resonating element arm structures (e.g., arms 102 and/or 100) and antenna ground 52.

Antenna feed F1, which is formed using terminals 94-1 and 96-1, may be coupled in a path that bridges opening 82. Antenna feed F2, which is formed using terminals 94-2 and 96-2, may be coupled in a path that bridges opening 82 in parallel with feed F1 and in parallel with short circuit path 98.

Resonating element arms 100 and 102 may form respective arms in a dual arm inverted-F antenna resonating element. Arms 100 and 102 may have one or more bends. The illustrative arrangement of FIG. 4 in which arms 100 and 102 run parallel to ground 52 and have bent ends that are separated from ground plane 52 by gaps 18 is merely illustrative.

Arm 100 may be a longer low-band arm that handles lower frequencies, whereas arm 102 may be a shorter high-band arm that handles higher frequencies. Arm 100 may allow antenna 40 to exhibit an antenna resonance at low band (LB) frequencies such as frequencies from 700 MHz to 960 MHz or other suitable frequencies. Arm 102 may allow antenna 40 to exhibit one or more antenna resonances at higher frequencies such as resonances at one or more frequencies in the range of 1710 to 2170 MHz (sometimes referred to as mid-band frequencies). Antenna 40 may also contain antenna resonating element structures (e.g., inverted-F antenna structures) that allow antenna 40 to resonate at higher frequencies such as frequencies between 2300 MHz to 2700 MHz (sometimes referred to as high band frequencies) or other suitable frequencies. The frequencies handled by antenna 40 may be cellular telephone frequencies and/or wireless local area network frequencies. Other frequencies (e.g., satellite navigation system frequencies, etc.) may also be handled if desired.

To provide antenna 40 with tuning capabilities, antenna 40 may include adjustable circuitry. The adjustable circuitry may be coupled between different locations on antenna resonating element 50. As shown in FIG. 4, for example, antenna 40 may include a tunable circuit such as adjustable inductor 110. Adjustable inductor 110 may have a first terminal (terminal 122) coupled to arm 100 of antenna resonating element 50 and a second terminal (terminal 124) coupled to antenna ground 52. Adjustable inductor 110 may be coupled across opening 82 in parallel with return path 98.

The adjustable circuitry of antenna 40 such as adjustable inductor 110 or other adjustable circuitry may be tuned using control signals from control circuitry 28 (FIG. 2). Control signals from control circuitry 28 may, for example, be provided to an adjustable capacitor, adjustable inductor, or other adjustable circuit using a control signal path that is coupled between control circuitry 28 and the adjustable circuit. In the example of FIG. 4, control circuitry 28 may provide control signals to input 112 to adjust the inductance exhibited by adjustable inductor 110, thereby tuning the frequency response of antenna structures 40.

Figure 5:
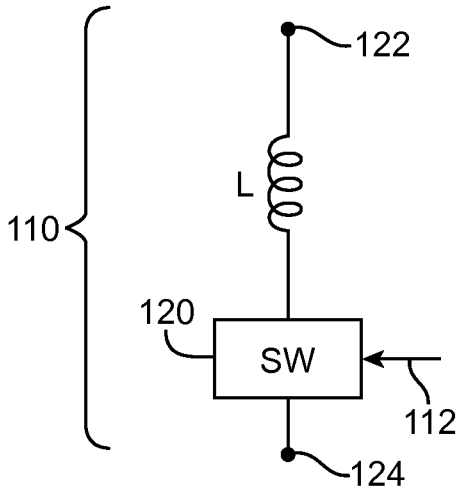
FIG. 5 is a diagram of an illustrative adjustable inductor based on a single fixed inductor that may be used in a tunable antenna in accordance with an embodiment of the present invention.

FIG. 5 is a schematic diagram of illustrative adjustable inductor circuitry 110 of the type that may be used in tuning antenna 40. In the FIG. 5 example, adjustable inductor circuitry 110 can be adjusted to produce different amounts of inductance between terminals 122 and 124. Switch 120 is controlled by control signals on control input 112. When switch 120 is placed in a closed state, inductor L is switched into use and adjustable inductor 110 exhibits an inductance L between terminals 122 and 124. When switch 120 is placed in an open state, inductor L is switched out of use and adjustable inductor 110 exhibits an open circuit between terminals 122 and 124.

Figure 6:
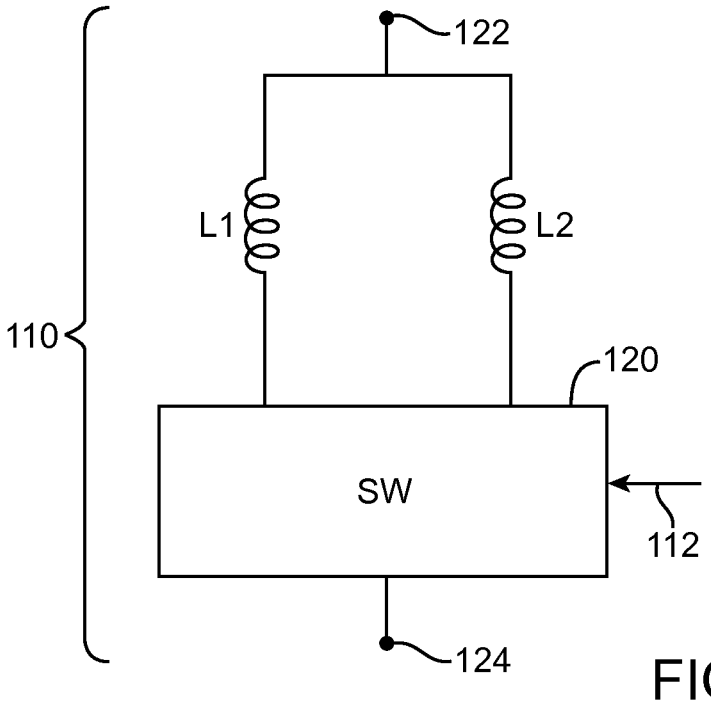
FIG. 6 is a diagram of an illustrative adjustable inductor based on multiple fixed inductors that may be used in a tunable antenna in accordance with an embodiment of the present invention.

FIG. 6 is a schematic diagram of adjustable inductor circuitry 110 in a configuration in which multiple inductors are used in providing an adjustable amount of inductance. Adjustable inductor circuitry 110 of FIG. 6 can be adjusted to produce different amounts of inductance between terminals 122 and 124 by controlling the state of switching circuitry such as switch 120 (e.g., a single pole double throw switch) using control signals on control input 112. For example, control signals on path 112 may be used to switch inductor L1 into use between terminals 122 and 124 while switching inductor L2 out of use, may be used to switch inductor L2 into use between terminals 122 and 124 while switching inductor L1 out of use, may be used to switch both inductors L1 and L2 into use in parallel between terminals 122 and 124, or may be used to switch both inductors L1 and L2 out of use. The switching circuitry arrangement of adjustable inductor 110 of FIG. 6 is therefore able to produce inductance values such as L1, L2, an inductance value associated with operating L1 and L2 in parallel, and an open circuit (when L1 and L2 are switched out of use simultaneously).

Figure 7:
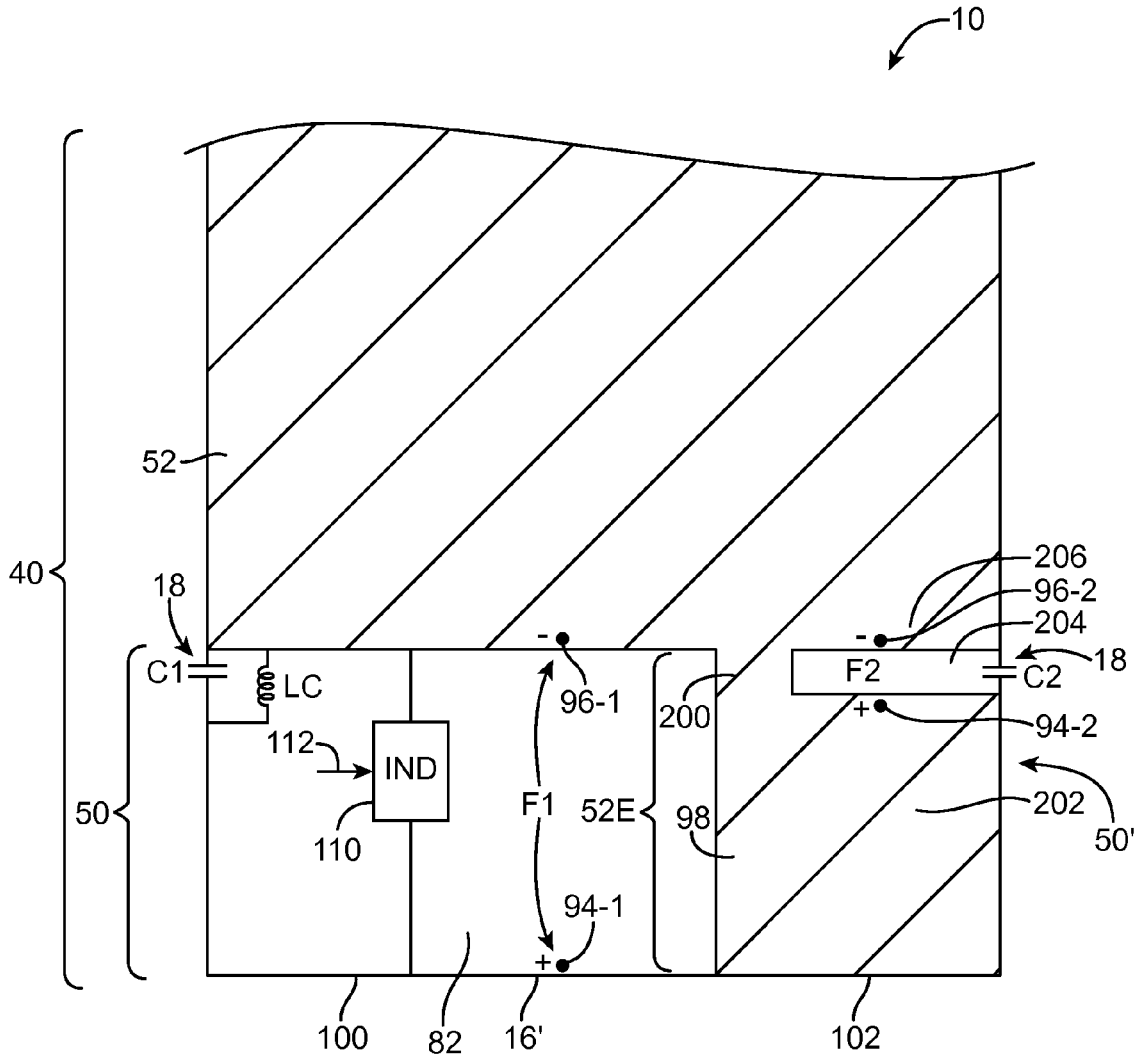
FIG. 7 is a diagram of an illustrative antenna with multiple feeds for covering multiple communications bands in an electronic device in accordance with an embodiment of the present invention.

FIG. 7 is a diagram of an illustrative antenna of the type that may be used to form antenna 40 of device 10. As shown in FIG. 7, dual arm inverted-F antenna resonating element 50 may be formed from portions 16' of peripheral conductive housing structures 16. Antenna resonating element 50 may include a first resonating element arm portion (arm) 102 and may include a second resonating element arm portion (arm) 100.

Ground 52 may have an extended portion 52E (sometimes referred to as planar conductive structures) that may be configured to form return path 98 between inverted-F antenna resonating element 50 and ground plane 52. Extended portion 52E may also form additional inverted-F antenna resonating element 50' for supporting high band (HB) communications when feed by antenna feed F2. A gap such as slot 204 may form an opening between portion 202 of extended portion 52E and portion 206 of ground 52. Portion 202 of extended portion 52E serves as the main arm of additional inverted-F antenna resonating element portion 50' of antenna resonating element 50 and antenna 40. Portion 200 of extended portion 52E serves as a return path (short circuit path) in additional inverted-F antenna resonating element portion 50' and is used to couple main arm portion 202 to ground 206.

Openings 18 between arms 100 and 102 may give rise to respective capacitances such as capacitances C1 and C2. Inductors may be incorporated into antenna 40 to compensate for one or both of capacitances C1 and C2. As shown in FIG. 7, for example, optional inductor LC may bridge the gap 18 that is associated with capacitance C1 to compensate for the presence of capacitance C1. Adjustable inductor 110 may be controlled by control signals applied to input 112. Inductor 110 may bridge opening 82 to couple the main resonating element arm formed from peripheral conductive structures 16' to ground 52.

Figure 8:
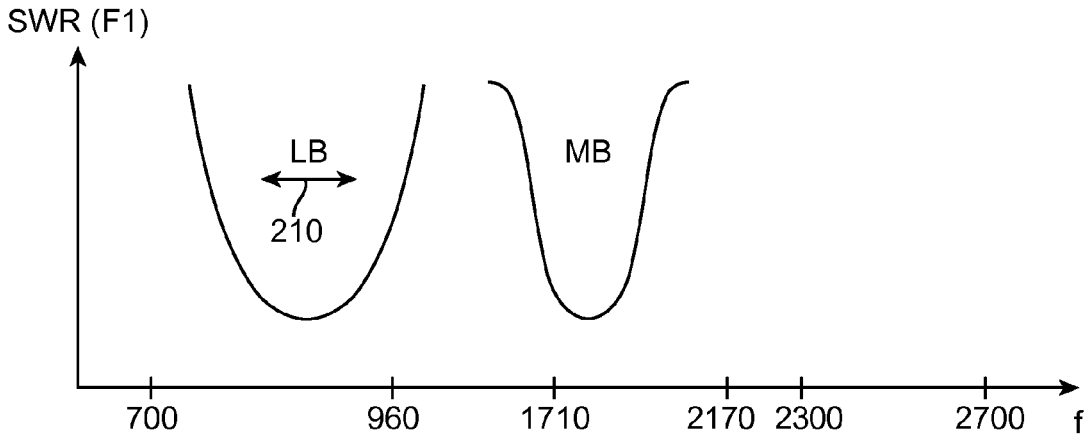
FIG. 8 is a graph in which antenna performance (standing wave ratio) has been plotted as a function of operating frequency when using a first feed of an antenna of the type shown in FIG. 7 in accordance with an embodiment of the present invention.

FIG. 8 is a graph in which antenna performance (standing wave ratio SWR) for antenna 40 of FIG. 7 has been plotted as a function of operating frequency f when radio-frequency signals are being transmitted and/or received through antenna feed F1. As shown in FIG. 8, the first antenna feed (feed F1) of antenna 40 may exhibit a low band resonance LB and a mid-band resonance MB.

In antenna 40 of FIG. 7, arm 100 may be longer than arm 102, so that arm 100 may be used in supporting an antenna resonance within low band LB. Arm 102 may contribute to an antenna resonance within mid-band MB. Low band (band LB) may extend from 700 to 960 MHz or may cover another suitable range of frequencies. Mid-band MB may lie within a frequency range of 1710 MHz to 2170 MHz or other suitable frequency range above low band LB. As indicated by line 210, adjustable inductor 110 of antenna 40 of FIG. 7 may be used to tune the antenna resonance associated with low band LB to ensure that all of low band LB is covered by antenna 40. When using feed F1, antenna 40 may not exhibit an appreciable response at frequencies above mid-band MB.

Figure 9:
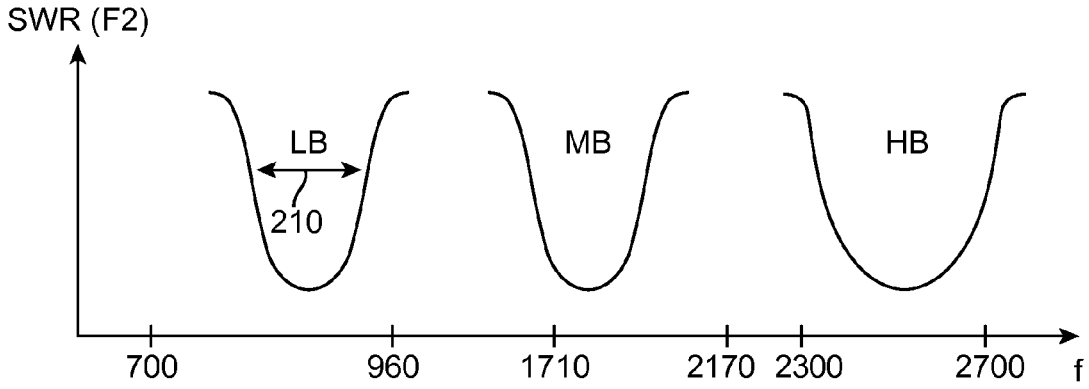
FIG. 9 is a graph in which antenna performance (standing wave ratio) has been plotted as a function of operating frequency when using a second feed of an antenna of the type shown in FIG. 7 in accordance with an embodiment of the present invention.

FIG. 9 is a graph in which antenna performance (standing wave ratio SWR) has been plotted as a function of operating frequency f when radio-frequency signals are being transmitted and/or received through antenna feed F2. Due to the presence of inverted-F antenna resonating element 50' within inverted-F antenna resonating element 50, antenna 40 may exhibit an antenna resonance in high band HB when using feed F2. Band HB may be a communications band in the range of 2300 to 2700 MHz or other suitable range of frequencies. Antenna 40 may also exhibit resonances in low band LB (e.g., a resonance tuned using inductor 110 as indicated by line 210) and mid-band MB when fed using antenna feed F2.

Figure 10:
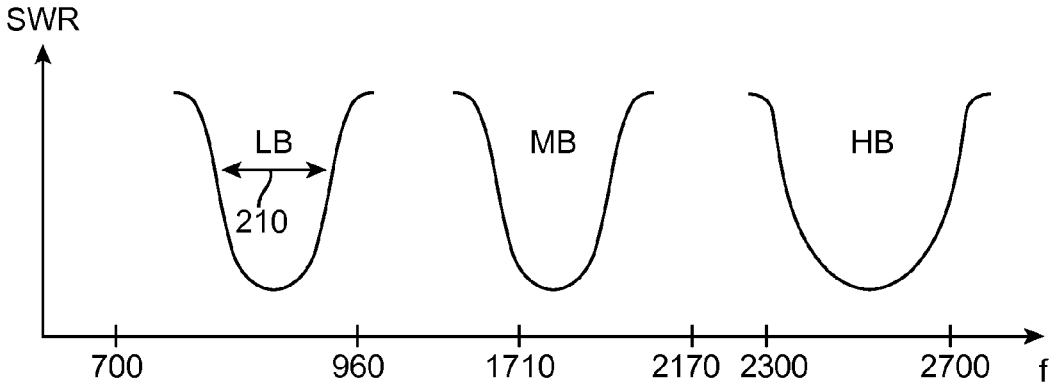
FIG. 10 is a graph in which antenna performance (standing wave ratio) has been plotted as a function of operating frequency when using both first and second feeds in an antenna of the type shown in FIG. 7 in accordance with an embodiment of the present invention.

When both feeds are active in antenna 40 (e.g., when a shared transmission line is used that a splitter divides into a first transmission line coupled to feed F1 and a second transmission line coupled to feed F2 or when other paths are used to couple wireless circuitry 90 to antenna 40), antenna 40 may exhibit a response of the type shown in FIG. 10. As shown in FIG. 10, antenna 40 may exhibit a tunable resonance in band LB, a mid-band resonance in band MB, and a high band resonance in band HB. In low band LB, the resonance from feed F1 may dominate. Contributions from feeds F1 and F2 may participate in the resonance in mid-band MB. At frequencies in band HB, the antenna may exhibit the resonance associated with use of feed F2.

Figure 11:
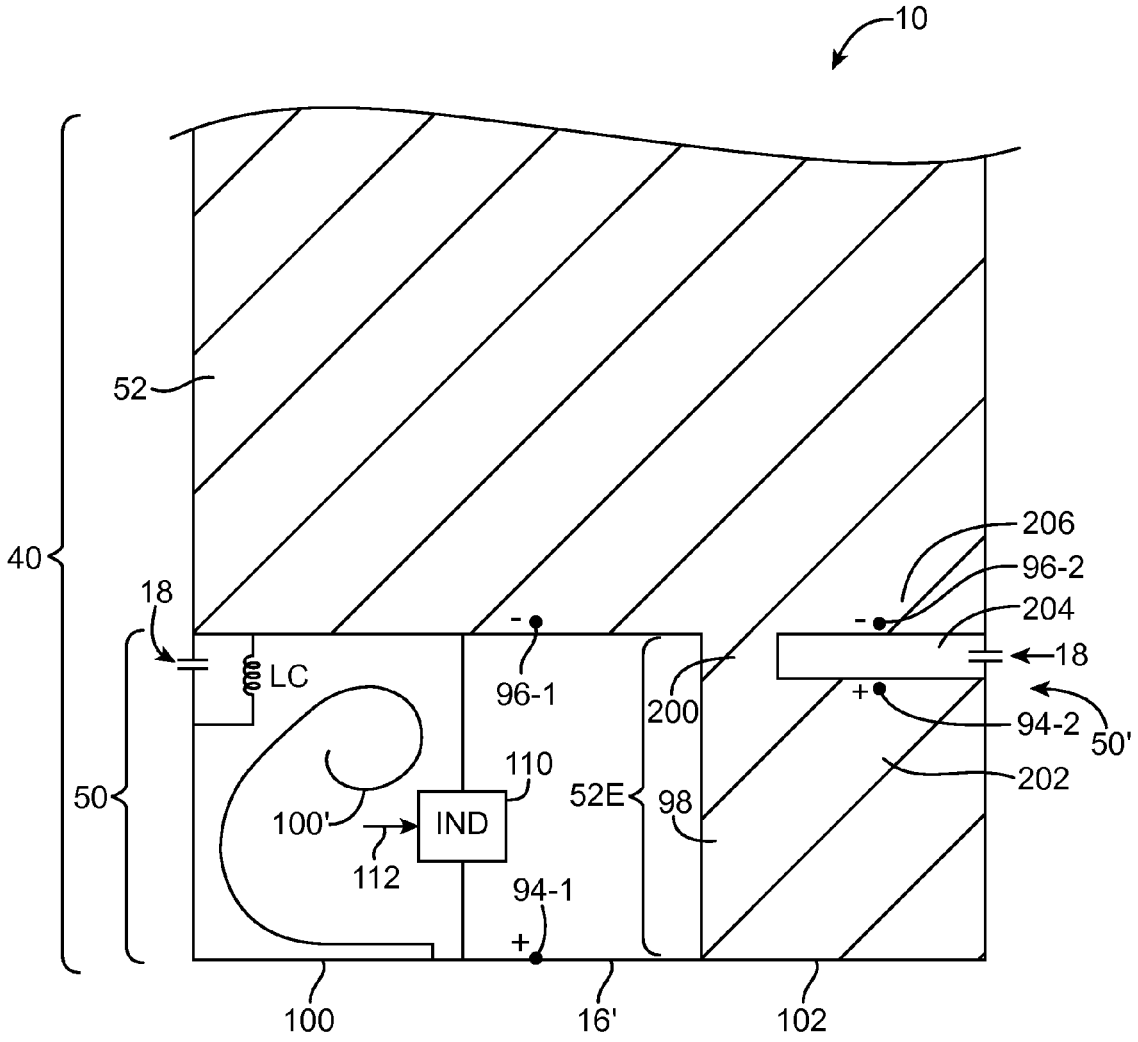
FIG. 11 is a diagram of an illustrative antenna with multiple feeds and multiple low band antenna resonating element branches for covering multiple communications bands in an electronic device in accordance with an embodiment of the present invention.

If desired, additional conductive structures may be added to antenna 40 to modify the frequency performance of antenna 40. As shown in FIG. 11, for example, antenna 40 may have an additional conductive structure such as resonating element arm structure 100'. Resonating element arm structure 100' may be formed from a strip of metal, patterned metal foil, traces on a printed circuit, a length of wire, internal housing structures, portions of conductive electronic components, an elongated metal path with a spiral shape, or other conductive components in device 10. Structure 100' may have a length that differs from that of arm 100. In this way, the portion of peripheral conductive housing structures 16 that form arm 100 may serve as a first low-frequency arm (branch) of the low-frequency (longer) arm in inverted-F antenna resonating element 50 and structure 100' may serve as a second low-frequency arm (branch) of the low-frequency (longer) arm in inverted-F antenna resonating element 50.

The lengths of each branch may be about a quarter of a wavelength at a low band resonant frequency of interest. The longer of the two branches of the low band resonating element arm may resonant at a lower frequency than the shorter of the two branches of the low band portion of antenna resonating element 50. The presence of two branches of the low-frequency portion of inverted-F antenna resonating element arm may give rise to two corresponding resonances in low band LB. The resonances may be overlapping (to broaden low band performance) or may be distinct (i.e., a region of unsatisfactory antenna performance may separate two acceptable low band resonances).

Figure 12:
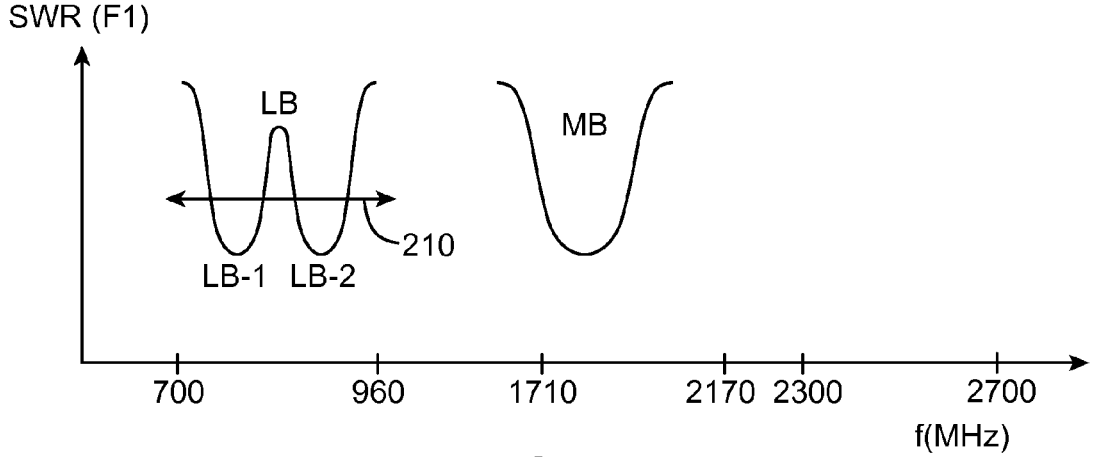
FIG. 12 is a graph in which antenna performance (standing wave ratio) has been plotted as a function of operating frequency when using a first feed of an antenna of the type shown in FIG. 11 in accordance with an embodiment of the present invention.

FIG. 12 is a graph in which antenna performance (standing wave ratio SWR) for antenna 40 of FIG. 11 has been plotted as a function of operating frequency f when radio-frequency signals are being transmitted and/or received through antenna feed F1. As shown in FIG. 12, the first antenna feed (feed F1) of antenna 40 of FIG. 12 may exhibit a low band resonance LB and a mid-band resonance MB. Low band resonance LB may be made up of first and second resonances LB-1 and LB-2 associated with the two different lengths of resonating element branch 100 and resonating element branch 100' of inverted-F arm 100 of resonating element 50. Arm 102 may contribute to an antenna resonance within mid-band MB.

Low band LB may extend from 700 to 960 MHz or may cover another suitable range of frequencies. Mid-band MB may lie within a frequency range of 1710 MHz to 2170 MHz or other suitable frequency range. As indicated by line 210, adjustable inductor 110 of antenna 40 of FIG. 12 may be used to tune the antenna resonances LB-1 and LB-2 that are associated with low band LB to ensure that all of low band LB is covered by antenna 40. When using feed F1, antenna 40 may not exhibit an appreciable response at frequencies above mid-band MB.

Figure 13:
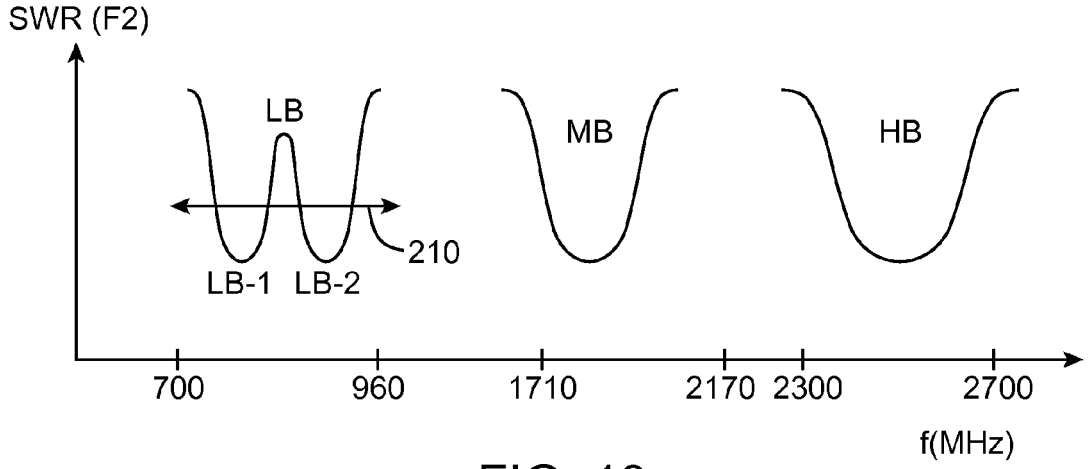
FIG. 13 is a graph in which antenna performance (standing wave ratio) has been plotted as a function of operating frequency when using a second feed of an antenna of the type shown in FIG. 11 in accordance with an embodiment of the present invention.

FIG. 13 is a graph in which antenna performance (standing wave ratio SWR) has been plotted as a function of operating frequency f when radio-frequency signals are being transmitted and/or received through antenna feed F2 of antenna 40 in FIG. 11. As with antenna 40 of FIG. 7, the presence of inverted-F antenna resonating element portion 50' of resonating element 50 may give rise to an antenna resonance in high band HB when using feed F2. Band HB may be a communications band in the range of 2300 to 2700 MHz or other suitable range of frequencies. Antenna 40 may also exhibit resonances in low band LB (e.g., resonances LB-1 and LB-2 that are tuned using inductor 110 as indicated by line 210) and mid-band MB when fed using antenna feed F2.

Figure 14:
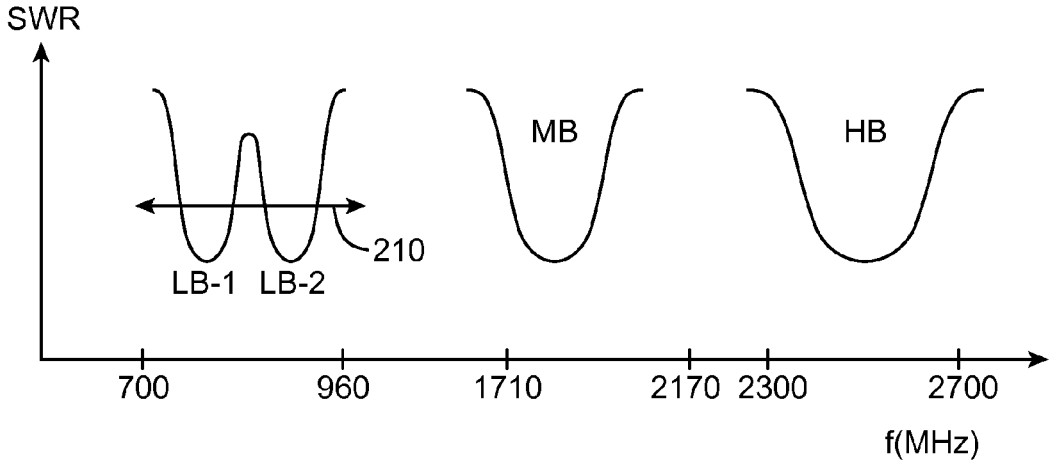
FIG. 14 is a graph in which antenna performance (standing wave ratio) has been plotted as a function of operating frequency when using both first and second feeds in an antenna of the type shown in FIG. 11 in accordance with an embodiment of the present invention.

When both feeds are active in antenna 40 (e.g., when a shared transmission line is used that a splitter divides into a first transmission line coupled to feed F1 and a second transmission line coupled to feed F2 or when wireless circuitry 90 is otherwise coupled to feeds F1 and F2), antenna 40 may exhibit a response of the type shown in FIG. 14. As shown in FIG. 14, antenna 40 may exhibit tunable resonances LB-1 and LB-2 in band LB, a mid-band resonance in band MB, and a high band resonance in band HB. In low band LB, the resonances from feed F1 may dominate. Contributions from feeds F1 and F2 may participate in the resonance in mid-band MB. At frequencies in band HB, antenna 40 of FIG. 11 may exhibit the resonance associated with use of feed F2 and resonating element structure 50'.

The foregoing is merely illustrative of the principles of this invention and various modifications can be made by those skilled in the art without departing from the scope and spirit of the invention.

What is claimed is:

1. An electronic device, comprising:

control circuitry; and an antenna that is tuned by the control circuitry, wherein the antenna has an inverted-F antenna resonating element and an antenna ground that are separated by a gap, wherein the antenna has a first antenna feed coupled across the gap, wherein the inverted-F antenna resonating element has conductive structures configured to form an additional inverted-F antenna resonating element portion of the inverted-F antenna resonating element, wherein the additional inverted-F antenna resonating element portion has a resonating element arm formed from the conductive structures that is separated from the antenna ground by an opening and has a return path formed from a portion of the conductive structures, and wherein the antenna has a second antenna feed coupled across the opening.

2. The electronic device defined in claim 1 wherein the antenna is configured to resonate in at least a first communications band, a second communications band that is higher in frequency than the first communications band, and a third communications band that is higher in frequency than the first communications band.

3. The electronic device defined in claim 1 wherein the antenna includes an adjustable inductor that bridges the gap and that is controlled by the control circuitry to tune the antenna.

4. The electronic device defined in claim 1 wherein the inverted-F antenna resonating element has at least first and second arms, wherein the first arm is longer than the second arm, wherein the first arm is configured to resonate in at least a first communications band, and wherein the second arm is configured to resonate in at least a second communications band that is higher in frequency than the first communications band.

5. The electronic device defined in claim 4 wherein the additional inverted-F antenna resonating element portion of the inverted-F antenna resonating element is configured to resonate in at least a third communications band that is higher in frequency than the second communications band.

6. The electronic device defined in claim 5 wherein the first arm includes first and second branches that resonate in the first communications band.

7. The electronic device defined in claim 6 wherein the first and second branches are configured to produce first and second antenna resonances at different respective frequencies in the first communications band and wherein the antenna includes an adjustable inductor that bridges the gap and that is controlled by the control circuitry to tune the first and second antenna resonances in the first communications band.

8. The electronic device defined in claim 1 further comprising an adjustable electrical component that is coupled in parallel with the first antenna feed across the gap.

9. The electronic device defined in claim 8 further comprising a short circuit path formed from a portion of the conductive structures, wherein the short circuit path is coupled between the inverted-F antenna resonating element and the antenna ground in parallel with the first antenna feed.

10. The electronic device defined in claim 9 wherein the first antenna feed is between the adjustable electrical component and the short circuit path.

11. The electronic device defined in claim 1 further comprising a peripheral conductive housing member, wherein the inverted-F antenna resonating element comprises a portion of the peripheral conductive housing member.

12. An electronic device, comprising:

control circuitry; and an antenna that is tuned by the control circuitry, wherein the antenna has an antenna resonating element and an antenna ground configured to resonate in at least a first communications band, a second communications band that is at a higher frequency than the first communications band, and a third communications band that is higher in frequency than the second communications band, and wherein the antenna resonating element has a first arm that is separated from the antenna ground by an opening and is configured to resonate in the first communications band and a second arm that is separated from the antenna ground by the opening and that is configured to resonate in the second communications band and conductive structures that are configured to resonate in the third communications band.

13. The electronic device defined in claim 12 wherein the antenna comprises a tunable component coupled between the antenna resonating element and the antenna ground and wherein the control circuitry tunes that antenna by controlling the tunable component.

14. The electronic device defined in claim 13 wherein the tunable component includes switching circuitry and an inductor.

15. The electronic device defined in claim 14 wherein the conductive structures comprise an extended portion of the antenna ground, wherein a portion of the extended portion of the antenna ground is separated from the antenna ground by a gap, wherein the antenna has a first feed coupled between the antenna resonating element and the antenna ground across the opening, and wherein the antenna has a second antenna feed that is coupled across the gap.

16. The electronic device defined in claim 15 wherein the portion of the extended portion of the antenna ground forms an inverted-F arm that is coupled to a positive antenna feed terminal in the second antenna feed.

17. The electronic device defined in claim 16 further comprising:

a ground antenna feed terminal in the second antenna feed that is coupled to the antenna ground; and additional conductive structures in the antenna, wherein the first arm comprises a portion of a peripheral conductive housing member, wherein the portion of the peripheral conductive housing member forms a first branch of the first arm and wherein the additional conductive structures form a second branch of the first arm.

18. An antenna, comprising:

a portion of a peripheral conductive electronic device housing structure; and an antenna ground that is separated from the portion of the peripheral conductive electronic device housing structure by an opening;

a first antenna feed that bridges the opening; and a second antenna feed coupled to an extended portion of the antenna ground, wherein the extended portion of the antenna ground forms an inverted-F antenna resonating element.

19. The antenna defined in claim 18 wherein a portion of the extended portion of the antenna ground forms a short circuit path between the portion of the peripheral conductive electronic device housing structure and the antenna ground, wherein the portion of the peripheral conductive electronic device housing structure and the antenna ground are configured to resonant in first and second communications bands using at least the first antenna feed, wherein the inverted-F antenna resonating element is configured to resonate in a third communications band using the second antenna feed, and wherein the second communications band is at frequencies between the first communications band and the third communications band.

20. The antenna defined in claim 19 wherein the portion of the peripheral conductive electronic device housing structure forms a first branch of an inverted-F antenna resonating element arm that resonates in the first communications band and wherein the antenna further comprises a second branch of the inverted-F antenna resonating element arm.

* * * * *